US005263391A

United States Patent [19]

Naylor

[11] Patent Number: 5,263,391

[45] Date of Patent: Nov. 23, 1993

[54] TOOL FOR INSTALLING AND REMOVING DOCK POSTS

[76] Inventor: John T. Naylor, 4150 Dunkirk, Toledo, Ohio 43606

[21] Appl. No.: 961,074

[22] Filed: Oct. 14, 1992

[51] Int. Cl.[5] ..... B25B 13/48

[52] U.S. Cl. ..... 81/176.2; 81/176.15; 81/60; 81/124.2

[58] Field of Search ..... 81/124.2, 176.1, 176.15, 81/176.2, 177.5, 60–63.2, 58.1, 461

[56] References Cited

U.S. PATENT DOCUMENTS 4,631,991 12/1986 Scott et al. ..... 81/176.2 X 5,033,501 7/1991 Stehling ..... 81/176.15 X

*Primary Examiner*—James G. Smith

*Attorney, Agent, or Firm*—Marshall & Melhorn

[57] ABSTRACT

A tool for installing and removing dock posts which includes a short tubular ratchet head. The tubular ratchet head is generally circular in cross-section and has angled teeth formed in the outer edge of both ends. The inner diameter of the ratchet head is sized to be slightly larger than the outer diameter of the dock posts, which permits the ratchet head of the tool to slide onto the top of the dock post. The tool slides down the dock post until the post turning bar inserted through the dock post engages the slot between the angled teeth in the lower edge of the ratchet head. If the tool of the present invention is rotated about the dock post in the direction which the teeth are pointing, the angled teeth on opposite sides of the ratchet head engage the post turning bar which causes the post turning bar and dock post to rotate in the same direction. When the tool is rotated in the opposite direction, the ratchet head disengages the post turning bar to permit the head of the tool to be repositioned for another power stroke to rotate the dock post. The ratchet head of the tool may be mounted in one direction for installation and the opposite direction form removing the dock posts.

15 Claims, 2 Drawing Sheets

TOOL FOR INSTALLING AND REMOVING DOCK POSTS

BACKGROUND OF THE INVENTION

1. Field of the Invention

The invention relates generally to a tool for turning a dock post, and in particular, to a heavy duty ratchet tool for installing and removing dock posts.

2. Summary of Related Art

Throughout the northern half of the United States and all of Canada, docks are installed each boating season in lakes, rivers, and ponds for use by sporting and recreational boaters. The docks used by the small to mid-size boats are typically installed each spring at the start of the boating season and removed in the fall.

In the winter when the lakes, rivers, and ponds freeze, the shifting of the ice formed in the body of water places tremendous stress on small structures in the water, such as boat docks. In most cases, the property owners with frontage on the water cannot justify the time, effort, and expense of installing and maintaining a year-around dock with sufficient strength to withstand the forces of winter. Consequently, the docks installed for use by sport and recreational boaters are typically installed and removed each season.

Because of the shallow water along the shore line, the docks generally extend perpendicular from the shore line into the water. Pairs of dock posts are installed at regular intervals in the bottom of the lake. The posts extend above the water and a cross bar is clamped between a pair of dock posts. The dock platform is then placed upon and connected to the cross bars to form the dock. The dock platform may be made of treated wood planks, extruded aluminum planks, or other similar material.

The dock posts have a standard outer diameter and vary in length from 3 feet to over 12 feet. The dock posts have an auger head formed in one end to facilitate the installation of the dock posts into the bottom of the lake. When the dock post is rotated in a clockwise direction, the auger head drives the dock post into the ground. The dock posts are provided with cross holes near the top of the post for receiving a post turning bar. The post turning bar is inserted through the holes and is used to rotate the dock post when installing and removing the dock post.

The post turning bars are short, thin pieces of stainless steel bar. The existing post turning bars are difficult to use because the bars are too thin to obtain a good grip and too short to provide adequate leverage. Since the post turning bar does not have a ratchet feature, the person installing or removing the dock post must constantly change positions to turn the wrench.

In the spring, the water temperature is quite cool. Since a person installing a dock post is standing in the water, it is desirable to minimize the time it takes to install the posts for the dock. In lakes with hard bottoms, it is often difficult to turn the wrench to drive the dock post into the ground. A person installing a dock post with a regular post turning bar will typically have to move his feet every quarter turn in order to achieve the leverage necessary to turn the dock post. On a slippery lake bottom which is often on a slope, it is very inconvenient to be constantly changing positions.

SUMMARY OF THE INVENTION

In accordance with the present invention, there is provided a tool for installing and removing dock posts. The tool includes a tubular ratchet head which is typically circular in cross-section. The tubular ratchet head is open and has angled teeth form in the outer edge of both ends for engaging the post turning bar inserted in the post.

Two steel tubular segments are welded to the ratchet head on opposite sides of the outer surface of the ratchet head. The tubular segments for the tool of the present invention are longer and thicker than the post turning bar inserted through the openings in the dock post.

The inner diameter of the ratchet head is sized to be slightly larger than the outer diameter of the dock posts, which permits the ratchet head of the tool to slide onto the top of the dock post. The tool slides down the dock post until the post turning bar engages the lower edge of the ratchet head.

The ratchet heads contain an even number of angled teeth on both ends. The angled teeth on each end of the ratchet head are spaced equal distance apart with slots formed between the angled teeth. When the ratchet head is lowered onto the post turning bar, the post turning bar is positioned in slots on opposite sides of the edge of the ratchet head. If the tool of the present invention is rotated about the dock post in the direction which the teeth are pointing, the angled teeth on opposite sides of the ratchet head engage the post turning bar which causes the post turning bar and dock post to rotate in the same direction. When the tool is rotated in the opposite direction, the ratchet head disengages the post turning bar to permit the head of the tool to be repositioned for another power stroke to rotate the dock post.

The teeth on the ratchet head are all angled in a clockwise direction when one end of the ratchet head engages the post turning bar. This edge of the ratchet head is positioned on the post turning bar to install the dock posts. When the tool is reversed or turned over and the other end of the ratchet head is positioned to engage the post turning bar, the teeth are then all angled in a counterclockwise direction to facilitate removal of the dock post.

An object of the present invention is to provide a tool that can reduce the time and effort required to install and remove dock posts. A tool with a longer and thicker handle than the post turning bar improves the leverage of the person installing or removing a dock post. The ratchet feature permits the user to find a secure position for using the tool and maintain that position for installation of a dock post. The improved leverage and ratcheting feature significantly reduces the time to install a dock post. In the spring, when the water temperature is still quite cool, reducing the time in the water is an important benefit to the user.

Another object of the present invention is to provide a tool that is not affected by use in water. When installing or removing dock posts, the tool will become wet through contact with the lake water. Standard ratchet wrenches will rust and bind up after use in the water.

A further object of the present invention is to provide a low cost ratchet head that can be used for installing and removing the dock posts. The ratchet head should operate in both a clockwise and counterclockwise direction.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
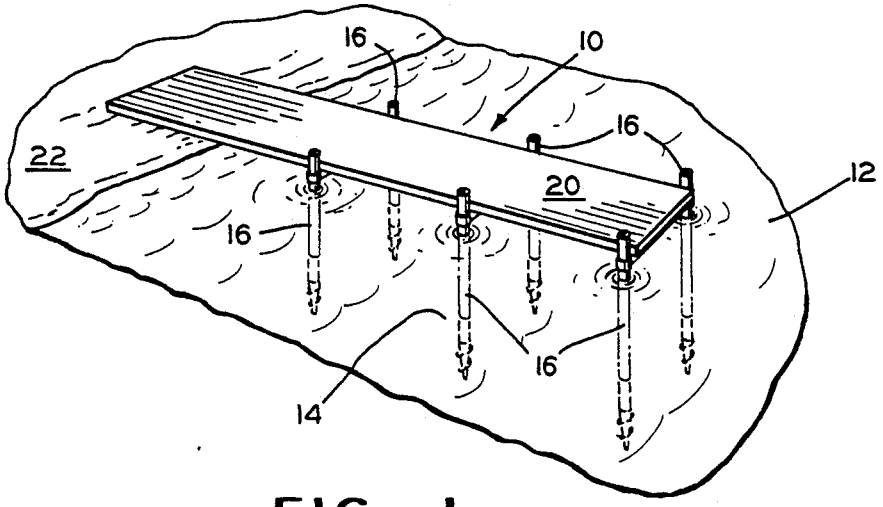
FIG. 1 is a perspective view showing a lake with a dock supported by dock posts.

Referring now to the drawings, there is shown in FIG. 1 a perspective view of a dock 10 in a lake 12 or some other body of water. The lake bottom 14 has a number of dock posts 16 extending from the lake bottom 14 to above the surface of the lake 12. The dock posts 16 are installed in pairs with an individual dock post 16 being spaced approximately three feet from the other dock post 16 of the pair. A cross bar 18 extends between the dock posts 16 and is clamped to each dock post above the surface of the lake 12.

The surface 20 of the dock 10 may be made from planks of treated and painted wood, aluminum planks or other suitable material. The dock surface 20 is supported by the dock posts 16 and rest on the top of the cross bars 18.

The dock 10 extends from the shoreline 22 into the lake 12. The first pair of dock posts 16 are approximately three to six feet from the shoreline 22. Subsequent pairs of dock posts are spaced six to eight feet and as far apart as 14 feet from the adjacent pair of dock posts 16.

The dock posts 16 are provided in standard lengths starting at three feet and extending up to twelve feet. The appropriate length of dock post 16 is generally determined by the water depth of the lake 12.

Figure 2:
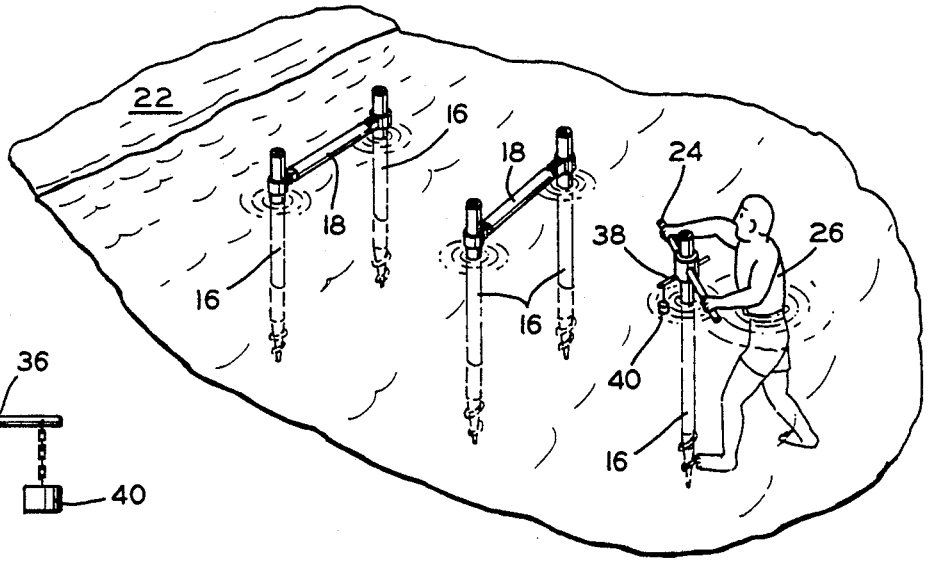
FIG. 2 is a perspective view showing a person installing a dock post.

FIG. 2 shows the tool 24 of the present invention being used by a person 26 to install a dock post 16. The dock post 16 includes an auger head 28 for boring into the bottom 14 of the lake 12. As the person 26 rotates the dock post 16 in a clockwise direction, the auger head 28 bores into the bottom 14 and secures the dock post 16. The installation depth of the dock post 16 into the lake bottom 14 depends on the type of soil conditions at the bottom 14. The dock posts 16 must be inserted more deeply in sandy soil than with a dock post 16 mounted in a clay bottom. The dock post 16 is rotated in a counterclockwise direction to remove the dock posts 16 when the dock 20 is removed from the lake 12 at the end of the boating season.

Figure 3:
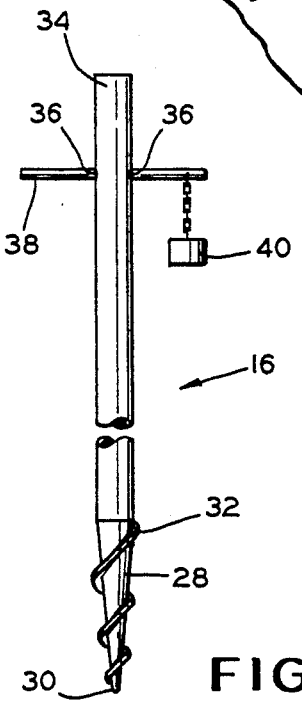
FIG. 3 is a elevational view of a dock post showing a standard post turning bar inserted through the post for rotatably installing or removing a dock post.

The ends of the dock post 16, including the auger head 28, are shown in more detail in FIG. 3. The auger head 28 has a tapered tip 30 and an expanding spiral surface 32 extending approximately eight to twelve inches up the dock post 16. The dock post 16 is installed by applying a downward force to start the tip 30 into the bottom 14 of the lake 12. After the tip 30 is started, the dock post 16 is driven into the bottom 14 by rotating the dock post 16 in a clockwise direction.

The top end 34 of the dock post 16 includes apertures 36 on opposite sides of the dock post 16. A post turning bar 38 may be inserted into the apertures 36 in order to rotate the dock post 16. The post turning bar 38 is typically a piece of stainless steel solid rod approximately eighteen inches long with a one-half inch diameter. The post turning bar 38 is shown with a flotation device 40, which is used to locate the wrench 38 in case the wrench 38 is accidentally dropped into the lake 12.

The post turning bar 38 furnished as standard equipment is difficult to grip and often does not provide sufficient leverage to rotate the dock post 16. When installing or removing a dock post 16, the installation person 26 will be constantly changing his position to obtain the proper leverage to rotate the post turning bar 38. The bottom 14 of the lake 12 may be uneven and slippery, which makes it difficult to be constantly changing positions for rotating the post turning bar 38.

Figure 4:
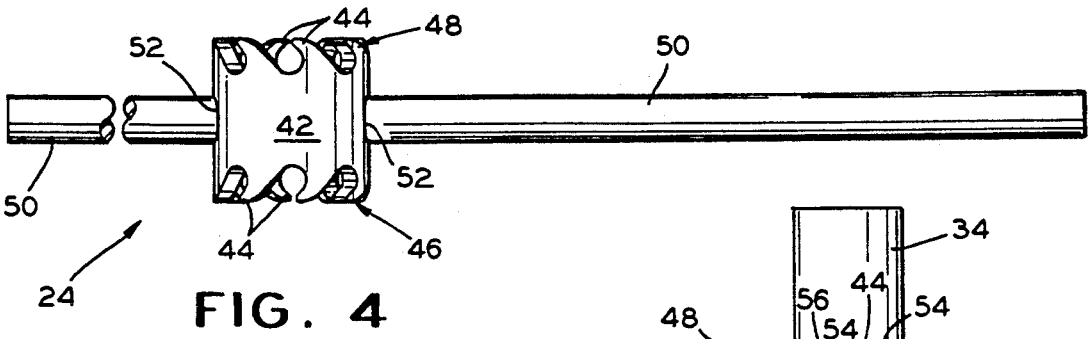
FIG. 4 is an elevational view of the tool of the present invention.

FIG. 4 shows the tool 24 of the present invention. The ratchet head 42 is a tubular element, such as a steel pipe, with an inner diameter larger than the outer diameter of the dock posts 16. The inner diameter is typically 2.25 to 2.5 inches. The ratchet head 42 includes angled teeth 44 machined in the two outer edges of the ratchet head 42. Instead of starting with steel pipe and then machining the teeth, the ratchet head 42 and teeth 44 may also be formed by standard die casting procedures to achieve the desired shape and strength of the tubular element.

Because the dock posts typically have a circular cross-section, the ratchet head 42 is shown with a circular cross-section in the preferred embodiment. However, the ratchet head 42 may be a tubular element with a cross-section with any number of sides so long as the angled teeth 44 are properly aligned.

The angled teeth 44 point in the same direction and have identical spacing on both ends of the ratchet head 42. When one end 46 of the ratchet head 42 is the first end lowered onto the top end 34 of the dock post 16, the teeth 44 are all pointing in a clockwise direction. This is the position for installing the dock posts by rotating the dock post in a clockwise direction. When the other end 48 of the ratchet head 42 is the first end lowered onto the top end 34 of the dock post 16, all of the teeth 44 are pointing in a counterclockwise direction. This is the position for removing the dock posts 16.

Two handles 50 are made from tubular steel elements. The handles 50 are each approximately 18 inches in length, which provides a total tool length of over three feet. One end 52 of each of the two handles 50 of the tool 24 are welded to the side surfaces of the ratchet head 42. The end 52 of the handle 50 and the surface of the ratchet head 42 may be machined to better match the surfaces and improve the overall strength of the weld.

Figure 5:
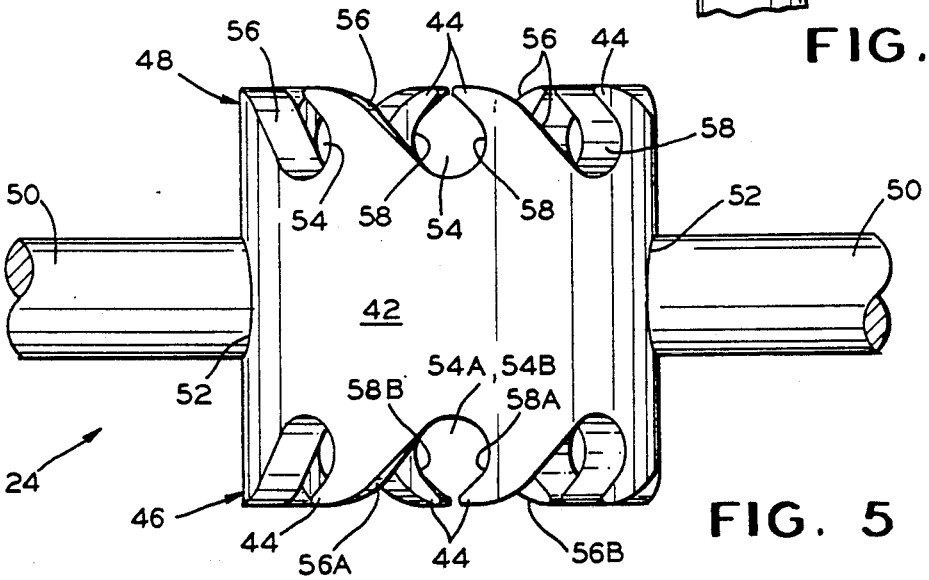
FIG. 5 is a side plan view of the ratchet head of the tool.
Figure 6:
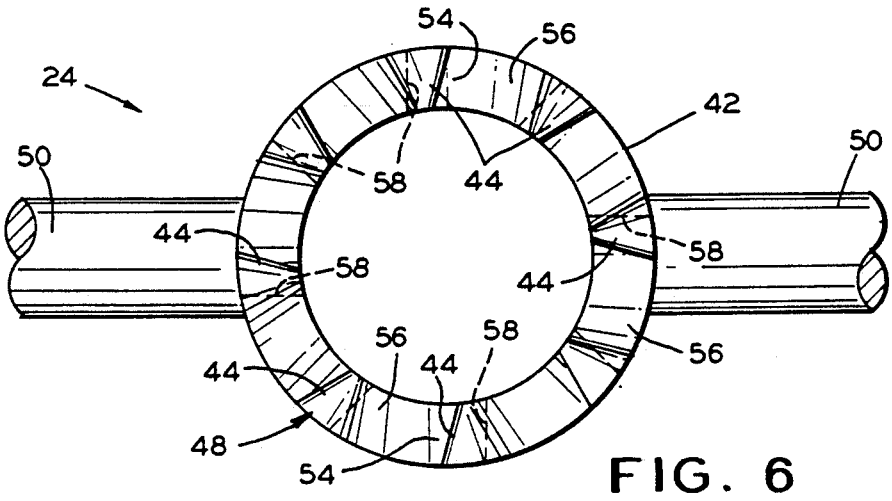
FIG. 6 is a top plan view of the ratchet head.

FIGS. 5 and 6 show the side view and top view of the ratchet head 42. Slots 54 having curved sides 56 and 58 are formed between adjacent teeth 44. The teeth are angled at approximately 45 degrees to the edge of the ratchet head 42 and have an outwardly curved surface 56 and an inwardly curved surface 58. The slots are aligned 180 degrees apart on the end of the ratchet head 42 such that the when the tool 24 is lowered onto the dock post 16, the post turning bar 38 slidingly engages the two slots 54 on opposite sides of the ratchet head 42.

Figure 7:
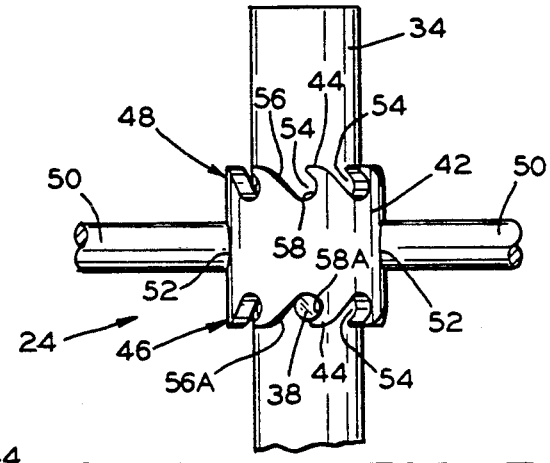
FIG. 7 is an elevational view of the tool mounted on a post turning bar and dock post.

As the tool 24 slides down the dock post 16 with the end 46 of the ratchet head 42 being position to engage the post turning bar 38 as shown in FIG. 7 , the post turning bar 38 will initially contact the outwardly curving sides 56A and 56B on opposite sides of the ratchet head 42. Once the initial contact is made, rotating the tool 24 in a clockwise direction will cause the post turning bar 38 to slide into the slots 54A and 54B.

After the post turning bar 38 is positioned in the slots 54A and 54B, the inwardly curved surfaces 58A and 58B of the slots 54A and 54B engage the post turning bar 38 during a power stroke during which the clockwise movement of the tool 24 causes the post turning bar 38 and dock post 16 to rotate in a clockwise direction with the dock post 16 being drawn into the lake bottom 14 by the auger head 28. After the person 26 using the tool 24 completes approximately a quarter turn power stroke, the tool 24 may be rotated in a counterclockwise direction to disengage the ratchet head 42 from the post turning bar 38, which exits the slots 54A and 54B by sliding along surfaces 58A and 58B. The tool is rotated counterclockwise without resistance back to the desired position for the start of a power stroke. When the tool 24 is then rotated in a clockwise position, the post turning bar 38 slides into a different pair of slots 54 to engage surfaces 58 for rotating the dock post 16. By standing in one position, the person 26 may continue the ratcheting process until the dock post 16 is installed at the proper depth.

As noted above, when the opposite end 48 is lowered onto the dock post 16 to engage the post turning bar 38, the teeth 44 point in a counterclockwise direction for removing the dock post 16. The power stroke occurs when the tool 24 is rotated in a counterclockwise direction. The engagement of the post turning bar 38 and the ratcheting of the tool 24 occur in the same manner as the installation process discussed above.

The tool 24 of the present invention, with its ratchet head 42 and extended arms 50, provides a faster and more convenient means for installing and removing dock posts 16 as compared to the standard post turning bar 38.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A tool for rotatably engaging a post turning bar inserted through a dock post during the installation and removal of the dock post, said tool comprising:

a) an open-ended tubular element;

b) a pair of handles extending from an outer surface of said tubular element in spaced apart relationship; and c) ratchet means formed in both an outer edge of a first end and an outer edge of a second end of said tubular element, whereby said ratchet means on either the first end or the second end of said tubular element selectively engages the post turning bar when said tubular element is inserted onto the dock post, and whereby the rotation of the tubular element causes the post turning bar to rotatably move the dock post.

2. The tool defined in claim 1 wherein said handles are tubular steel handles spaced 180 degrees apart and welded to the outer surface of said tubular element.

3. The tool defined in claim 1 wherein said tubular element is provided with a generally circular cross-section.

4. The tool defined in claim 1 wherein said tubular element is made from steel pipe.

5. The tool defined in claim 1 wherein said tubular element is made from a cast metal.

6. The tool defined in claim 1 wherein said ratchet means includes a plurality of angled teeth.

7. The tool defined in claim 1 wherein said ratchet means includes a plurality of angled teeth formed in the outer edge of the first end and a plurality of angled teeth formed in the outer edge of the second end of said tubular element.

8. The tool defined in claim 7 wherein the plurality of angled teeth in the first end are in spaced apart relationship and the plurality of angled teeth in the second end are in spaced apart relationship.

9. The tool defined in claim 8 including curved engagement surfaces formed between adjacent teeth for engaging the post turning bar.

10. The tool defined in claim 8 wherein the angled teeth in said ratchet means extend from the outer edges of said tubular element at approximately a 45 degree angle.

11. The tool defined in claim 8 wherein the angled teeth in the outer edge of the first end are aligned in the same direction as the angled teeth in the outer edge of the second end.

12. The tool defined in claim 8 wherein the angled teeth and curved engagement surfaces in the outer edge of the first end have identical spacing as the angled teeth and curved engagement surfaces of the second end.

13. A tool for rotatably engaging a post turning bar inserted through a dock post during the installation and removal of the dock post, said tool comprising:

a) an open-ended tubular element;

b) a pair of handles extending from an outer surface of said tubular element;

c) a plurality of angled teeth in spaced apart relationship formed in an outer edge of a first end of said outer surface for selectively engaging the post turning bar when said tubular element is inserted onto the dock post in one direction whereby the clockwise rotation of the tubular element causes the post turning bar to rotatably move the dock post in a downward direction; and d) a plurality of angled teeth in spaced apart relationship formed in an outer edge of a second end of said tubular element for selectively engaging the post turning bar when said tubular element is inserted onto the dock post in the opposite direction, whereby the counterclockwise rotation of the tubular element causes the post turning bar to rotatably move the dock post in an upward direction.

14. The tool defined in claim 13 wherein the angled teeth in said ratchet means extend from the outer edges of said tubular element at approximately a 45 degree angle.

15. The tool defined in claim 13 including curved engagement surfaces formed between adjacent teeth for engaging the post turning bar.

* * * * *